US010722920B2

(12) United States Patent
Berdelle-Hilge

(10) Patent No.: US 10,722,920 B2
(45) Date of Patent: Jul. 28, 2020

(54) DEVICE AND METHOD FOR DELIVERY POINT SORTING

(71) Applicant: SIEMENS AKTIENGESELLSCHAFT, Munich (DE)

(72) Inventor: Peter Berdelle-Hilge, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/901,165

(22) Filed: Feb. 21, 2018

(65) Prior Publication Data

US 2018/0236495 A1 Aug. 23, 2018

Related U.S. Application Data

(60) Provisional application No. 62/461,456, filed on Feb. 21, 2017.

(51) Int. Cl.
*B07C 3/08* (2006.01)

(52) U.S. Cl.
CPC ..... *B07C 3/08* (2013.01)

(58) Field of Classification Search
CPC .. B07C 3/06; B07C 3/065; B07C 3/08; B07C 3/082; B07C 3/085; B07C 5/361; B07C 5/362; B07C 5/38; B07C 2301/0041
See application file for complete search history.

(56) References Cited

U.S. PATENT DOCUMENTS 4,244,672 A * 1/1981 Lund ..... B07C 3/02 198/349.7
6,677,548 B2 * 1/2004 Robu ..... B07C 3/08 209/583
7,060,926 B2 * 6/2006 Edmonds ..... B07C 3/00 209/584
7,126,074 B1 * 10/2006 Berceli ..... B07C 3/00 209/583
7,414,218 B2 * 8/2008 Wheeler ..... B07C 3/02 198/370.01
7,728,245 B2 * 6/2010 Redford ..... B07C 3/00 209/584

(Continued)

FOREIGN PATENT DOCUMENTS

WO 2005075116 A1 8/2005

*Primary Examiner* — Joseph C Rodriguez
(74) *Attorney, Agent, or Firm* — Laurence Greenberg; Werner Stemer; Ralph Locher

(57) ABSTRACT

A delivery point sorting device with two feeders for receiving and forwarding mail in streams, where a diverging apparatus divert module is configured to process the mail from the two feeders and a merge module converges the streams of mail from the two feeders and distributes the mail to respective endpoints. Sorting endpoints are used for loading the mail received from this converging apparatus. A method where items of mail are sorted through sorting passes including a first, second, and third sorting pass. Sorting passes are; processing mail through two feeders by receiving the mail by the feeders and forwarding the mail articles in streams of mail, converging the streams of mail from the feeders to a conveyor apparatus, loading the mail at sorting endpoints by the conveyor apparatus, and sequentially passing the mail through the first, second, and third sorting pass.

6 Claims, 3 Drawing Sheets

(56) References Cited

U.S. PATENT DOCUMENTS

| | | | | |
|---|---|---|---|---|
| 7,820,932 | B2 * | 10/2010 | Stemmle | B07C 3/00 209/583 |
| 8,369,985 | B2 * | 2/2013 | Stemmle | B07C 3/082 209/539 |
| 8,374,720 | B2 * | 2/2013 | Kechel | B07C 3/02 209/542 |
| 8,457,781 | B2 * | 6/2013 | Bailey | B07C 3/00 700/224 |
| 8,766,128 | B2 * | 7/2014 | Stemmle | B07C 3/00 209/584 |
| 8,965,566 | B2 * | 2/2015 | Berdelle-Hilge | B07C 3/02 700/213 |
| 2003/0141226 | A1 * | 7/2003 | Morikawa | B07C 5/18 209/584 |
| 2005/0247606 | A1 | 11/2005 | Redford et al. | |
| 2008/0041770 | A1 * | 2/2008 | Mileaf | B07C 3/02 209/584 |
| 2008/0087582 | A1 * | 4/2008 | Zimmermann | B07C 3/06 209/552 |
| 2009/0145819 | A1 * | 6/2009 | Zimmermann | B07C 3/02 209/706 |
| 2010/0076593 | A1 * | 3/2010 | Martin | B07C 1/04 700/223 |
| 2011/0046775 | A1 * | 2/2011 | Bailey | B07C 3/00 700/224 |

* cited by examiner

DEVICE AND METHOD FOR DELIVERY POINT SORTING

CROSS-REFERENCE TO RELATED APPLICATION

This application claims the benefit, under 35 U.S.C. § 119(e), of provisional patent application No. 62/461,456 filed Feb. 21, 2017; the prior application is herewith incorporated by reference in its entirety.

BACKGROUND OF THE INVENTION

Field of the Invention

The present invention relates to a device and method for delivery point sorting. In particular, the present invention relates to a device and a method for the production of a delivery point sequence which corresponds to the sequence of the mailboxes on the route of a mail carrier. Delivery point sorting establishes such a sequence.

A series of delivery point sorting methods for letters have been disclosed in the art which are based on the use of the RADIX method with two sorting passes using a feeder. This method involves sorting mail with a delivery point sequence (delivery address code on the mail articles) by performing a first sorting pass to mail articles and a second sort pass to mail articles, where mail articles are supplied to the first sorting assembly, which identifies a sequence digit/variable; the mail articles are then conveyed to the second sorting assembly which identifies a further sequence digit/variable, and the mail articles are sorted in delivery point sequence. By increasing the number of sorting passes, the required number of sorting end points can be reduced, but at the same time, this increases the sorting period and/or correspondingly reduces the sorting throughput rate.

Mail is typically received in distribution centers or warehouses from two sources. Local mail which is to be delivered within the local area or to other distribution centers and out-of-area mail received from other distribution centers are the two sources. Mail which is to be delivered locally needs to ultimately be sorted to delivery point sequence, also known as carrier walk sequence. As in, the mail is sorted and arranged in the same order which the mail carrier travels while delivering mail articles. Delivery Bar Code Sequenced (DBCS) machines, which require two or more passes of the mail through the same sequence, are capable of achieving delivery point sequence for letter mail.

A process exists today to sort mail into a mail carrier route sequence, known as delivery point sequence. The mail is passed through a letter sorting machine two times. The first pass arranges the mail into groupings of addresses from the rather random order which the mail arrives. The number of output bins of the sorting machine determines the number of address sequences used.

Generally, a sorting matrix will provide places to hold the mail in a sorted order. The sorting matrix has a grouping of slots; each slot represents an address (or addresses) on the carrier's route. A sorting matrix with a larger number of slots allows for a bigger mail carrier route (or more individual smaller mail carrier routes) to be processed at a time. In a scenario where the letter sorting machine contains the same amount of sorting bins as addresses on the carrier's route, each address's mail would be sorted into a separate individual bin, A letter sorting machine can process mail for more addresses then sorting bins by using grouping slots.

As an example, a first address' mail would go into the first bin, the second address' mail into the second bin, and so on until the tenth address' mail goes into the tenth bin. Then an eleventh address' mail would be placed into the first bin, the twelfth into the second bin and so on until the twentieth address' mail goes into the tenth bin. In this example, the result would be bin 1 holding address' 1, 11, 21, 31 etc, bin 2 holding address' 2, 22, 32, etc.

After a first sorting pass, mail is usually moved from the letter sorting machine and loaded onto carts for storage and readied for a second pass. The first-pass sorted mail, while maintaining its order, will then be loaded for a second pass. The mail sorted into the first bin will be loaded first for the second pass and so on. This sequence must be maintained.

During a second pass, the mail from the first-pass' bin 1 is sorted with address 1 being sorted into bin 1, address 11 being sorted into bin 2, address 21 being sorted into bin 3, and so on until address 91 is sorted into bin 10. The mail from the first-pass' bin 2 is sorted with address 2 being sorted into bin 1, address 12 into bin 2, address 22 into bin 3, and so on until address 92 is sorted into bin 10. After all of the first-pass' 10 bins are processed through the letter sorting machine for a second pass, bin 1 will contain the sequence of addresses 1-10, bin 2 will contain the sequence of addresses 11-20 bin 2 will contain the sequence of addresses 21-30, and so on. So at the conclusion of the second pass, the mail is in mail carrier route sequence.

The number of sorting passes could be increased in order to reduce the number of endpoints; however this would reduce the throughput rate of the machines.

SUMMARY OF THE INVENTION

It is therefore the object of the present invention to solve the problems known in the prior art. In particular, it is an object of the present invention to specify a device and method for efficient and dependable delivery point sorting.

These objects are achieved by a device and method in accordance with the features of the claims. The invention utilizes three sorting passes and two feeders for reducing sorting end points without sacrificing throughput rate. Further advantageous embodiments of the invention are indicated in the respective dependent claims. It should be noted that the features presented individually in the dependent claims can be combined in any technologically meaningful way and define additional embodiments of the invention. Moreover the features indicated in the claims are specified and explained in greater detail in the description, wherein further preferred embodiments of the invention are described.

In particular, the objects are achieved according to the invention by a device for a delivery point sorting. The delivery point sorting device comprising:

- two feeders for processing mail articles, said two feeders receiving the mail articles and forwarding the mail articles in streams of mail articles;
- a crossing arrangement for streams of mail articles realized by a converging apparatus, said diverging apparatus having elevator modules with divert modules, and merge modules;
- said elevator modules configured to distribute the mail articles to respective sorting endpoints
- said divert modules configured to process mail from said two feeders;
- said merge modules for converging the streams of mail articles from said two feeders;

said sorting endpoints disposed downstream of said merge modules for stacking the mail articles received from said merge modules.

A significant reduction in the number of sorting end points is achieved with the three sorting passes. This reduces the space, footprint, and cost requirement needed for the sorting device. It allows for a relatively high filling level of the containers at the end of the sorting passes, and a relatively short final emptying process of the system after the feeder of the last item of mail. Since the number of not-full containers before the final emptying process of the system is lower corresponding to the reduction in the sorting end points. There is also the added advantage of compensating, or even over-compensating, the additional time requirement for the third sorting pass by using a second feeder.

In accordance with an added feature of the invention, the delivery point sorting device further comprises a storage module (GCM or gap correction module) configured to store an item of mail for a specific time in a stationary state, where the storage module is arranged upstream of the merge module in a flow direction of the streams of mail articles.

In accordance with an additional feature of the invention, the converging apparatus is configured for simultaneous convergence of the streams of mail articles from the at least two feeders.

In accordance with a further feature of the invention, the converging apparatus is configured for non-simultaneous convergence of the streams of mail articles.

The additional time requirement of the three sorting passes is completely compensated when virtual machines are not used and simultaneous converging is used, since in the first two sorting passes two feeders can be used, and only one feeder can be used in the time critical third sorting pass.

In accordance with another feature of the invention, the merge module is an active merge module. i.e. it merges two streams at the same time.

In accordance with a further feature of the invention, the delivery point sorting device further comprises at least two virtual machines, each with half of the number of said sorting endpoints.

When two virtual machines are used, the additional time requirement of using a third sorting pass is over-compensated if a device for the simultaneous converging of the two streams of items of mail from the two feeders is used in all three sorting passes.

When two virtual machines are used, the additional time requirement of using a third sorting pass is completely compensated if a device for the non-simultaneous converging of the two streams of items of mail from the two feeders is used and therefore only one feeder can be used (only) in the (rather non-time-critical) first sorting pass. This permits a simpler arrangement of the convergence.

In accordance with yet an added feature of the invention, the merge module is a passive merge module, i.e. it handles only one stream at the same time.

With the above and other features in view there is also provided, in accordance with the invention, a method for delivery point sorting. The method for delivery point sorting comprising:

sorting items of mail through a plurality of sorting passes including a first sorting pass, a second sorting pass and a third sorting pass;

each sorting pass including the following steps:

processing mail articles through at least two feeders by receiving the mail articles by the at least two feeders and forwarding the mail articles in streams of mail articles;

converging the streams of mail articles from the at least two feeders to at least one conveyor apparatus;

stacking the mail articles at sorting endpoints by the at least one conveyor apparatus, and sequentially passing the mail articles through the first sorting pass, subsequently through the second sorting pass, and subsequently through the third sorting pass.

A significant reduction in the number of sorting end points is achieved with the three sorting passes. This reduces the area and cost requirement needed for the sorting device. It allows for a relatively high filling level of the containers at the end of the sorting passes, and a relatively short final emptying process of the system after the last item of mail is fed. Since the number of non-full containers before the final emptying process of the system is lower corresponding to the reduction in the sorting end points. There is also the added advantage of compensating the additional time requirement for the third sorting pass by using a second feeder.

In accordance with an additional feature of the invention, the method for delivery point sorting further comprises, storing or delaying mail articles in a storage module for a specific time in a stationary state between passes, where said storage module is arranged upstream of said merge module in a flow direction of said streams of mail articles.

In accordance with an added feature of the invention, the method for delivery point sorting further comprises simultaneously converging the stream of mail articles from the at least two feeders.

In accordance with yet an added feature of the invention, the method further comprises converging the stream of mail articles non-simultaneously.

The additional time requirement of the three sorting passes is completely compensated when virtual machines are not used and simultaneous converging is used, since in the first two sorting passes two feeders can be used, and only one feeder can be used in the critical third sorting pass.

In accordance with an additional feature of the invention, the method for delivery point sorting further comprises, after the first sorting pass, dividing a volume of the mail articles from the first sorting pass into respectively equal parts between the two feeders at each sorting end point.

In accordance with another feature of the invention, the method for delivery point sorting, where after the second sorting pass, only one of the at least two feeders processes mail articles.

In accordance with a further feature of the invention, the method for delivery point sorting which further comprises providing two virtual machines each with half of the sorting endpoints.

When two virtual machines are used, the additional time requirement of using a third sorting pass is over-compensated if a method for the simultaneous converging of the two streams of items of mail from the two feeders is used in all three sorting passes.

When two virtual machines are used, the additional time requirement of using a third sorting pass is completely compensated if a method for the non-simultaneous converging of the two streams of items of mail from the two feeders is used and therefore only one feeder can be used (only) in the (rather non-time-critical) first sorting pass. This permits a simpler arrangement of the convergence.

In accordance with yet an added feature of the invention, the method further comprises preventing simultaneous converging of the stream of mail articles from the at least two feeders, and using one of the at least two feeders during a first sorting pass to serve both virtual machines.

Other features which are considered as characteristic for the invention are set forth in the appended claims.

Although the invention is illustrated and described herein as embodied in device and method for delivery point sorting, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

The exemplary embodiments of the present application relate to a letter sorting system with four levels which are arranged one above the other with sorting end points, known as a stacker wall. An elevator distributes the streams of mail articles from the two feeders among the four levels using divert modules. The elevator is arranged downstream of the feeders.

When two of the elevators are embodied one next to the other for in each case the two streams of items of mail from the feeders, the two streams can be merged for each level, known as a merge module, with only a quarter of the average throughput rate. Such an arrangement accordingly represents the necessary device for the simultaneous crossing of the streams of items of mail.

In order for the simultaneous convergence of the two respective partial streams, in each case a storage module is used in the two partial streams upstream of the merge module, which storage module can store an item of mail for a specific time in a stationary state (GCM or gap correction module).

The present invention can be configured with or without the use of virtual machines, which are subdivisions of the sorting device into two component-machines. The virtual machines are generally of the same size and are independent of one another. When no virtual machines are used, the device must permit simultaneous convergence of the streams of mail articles from the feeders. When virtual machines are used, the device must not permit simultaneous convergence of the stream of mail articles if only one feeder is used in the first sorting pass; one feeder serves both virtual machines in this embodiment.

Figure 1:
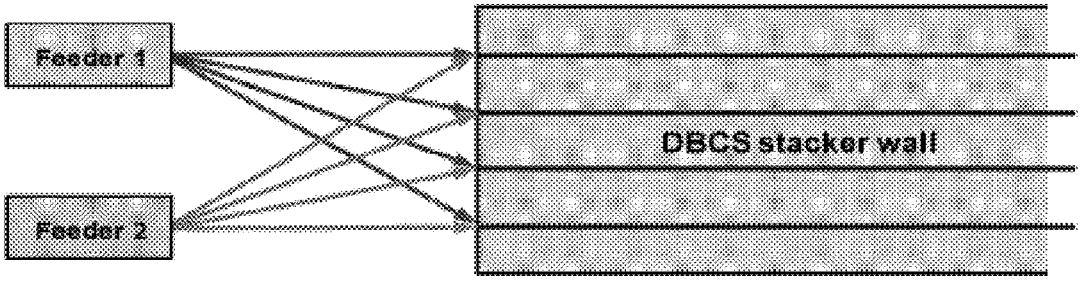
FIG. 1 shows a functional diagram of an embodiment of the delivery point sorting device.
Figure 2:
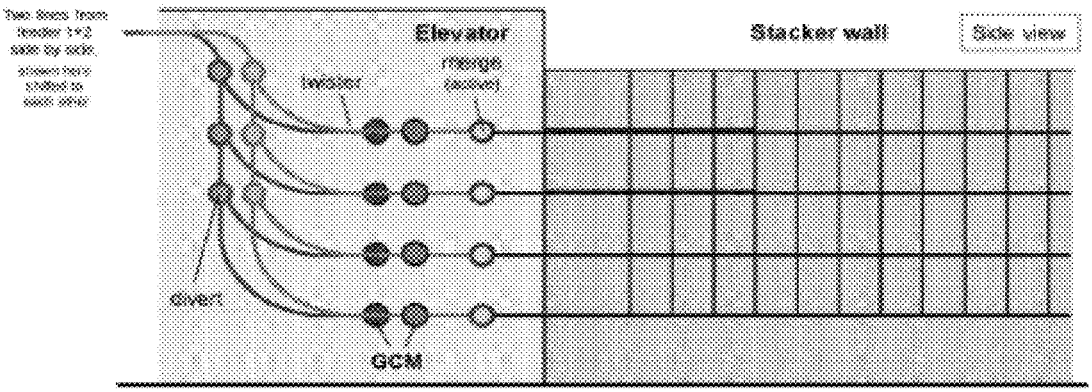
FIG. 2 shows a functional diagram of an embodiment of the delivery point sorting device.

FIGS. 1 and 2 show an exemplary embodiment representing a general arrangement with a device for the simultaneous convergence of two streams of items of mail from the feeders. This embodiment allows for, arrangements without the use of virtual machines to be implemented, in the same way as the arrangement with virtual machines in which just one feeder serves all four levels of the stacker wall in the first sorting pass:

FIG. 1 shows the function of the convergence device is shown for simultaneous convergence; where the device has two feeders. Each of the two feeders feed mail articles into each of the four shown levels of the stacker wall. The crossing functionality 3 is shown in the crossing streams of feeders 1 and 2.

FIG. 2 shows a convergence device according to the present invention for simultaneous convergence in the sorting passes 1, 2, 3, where the device has two feeders. The two lines from the feeders flow through the divert module, through the GCM, through the active merge module, finally into the stacker wall matrix. The crossing of the streams is realized in the convergence apparatus 1 having an elevator module 2 with divert module, and merge modules.

The device for converging two streams of mail articles from the two feeders becomes necessary if the latter are to be loaded by the same conveyor device or devices at the sorting end points. This is the case generally in letter sorting machines such as in the Delivery Point Barcode Sorter (DBCS) but not generally in large-format letter sorting machines such as the Open Mail Handling System (OMS) with its two separate pocket rings.

Without the formation of so-called virtual machines, which is the subdivision of the sorting device into two component-machines which are generally of the same size and are independent of one another, the converging device must permit simultaneous convergence of the stream of items of mail of the two streams of items of mail from the feeders. Also, in the sorting passes, after the first sorting pass the volume of the items of mail from the first sorting pass must be divided into respectively equal parts between the two feeders in each sorting end point. Since this is generally not precisely possible owing to the container delivery unit to the feeders, when the volume of items of mail of one sorting end point are separated from the first sorting pass, generally one of the two feeders must wait for the other until it has finished its portion. As a result, this brings about a reduction in the overall throughput rate. The three-stage sorting process means that unless virtual machines are formed the use of two feeders can take place only in the sorting passes 1 and 2, while in the third sorting pass only one of the two feeders can be appropriately used. This is due to the fact that the sequence of the items of mail of the volume of the items of mail to be separated from the second sorting pass must not be changed in specific regions at each sorting end point. Accordingly, different volume portions cannot be separated at the same time. The overall throughput rate over the entire delivery point sequencing process is as a result correspondingly reduced in the generally time-critical sorting passes after the first sorting pass, but is just as high as in a system with just one feeder and two sorting passes.

When two (or more) virtual machines are formed, the converging device must permit no simultaneous convergence of the stream of items of mail precisely if only one feeder is used (only) in the first sorting pass, which feeder then serves both virtual machines. Likewise, with such a configuration, the overall throughput rate is therefore also reduced over the entire delivery point sequencing process, but the reduction relates to the generally not too time-critical first sorting pass, but is also precisely just as high here as in a system with just one feeder and two sorting passes. In addition, there is no convergence-induced reduction in the throughput rate as occurs in the use of a convergence device for simultaneous convergence of the stream of items of mail.

Figure 3:
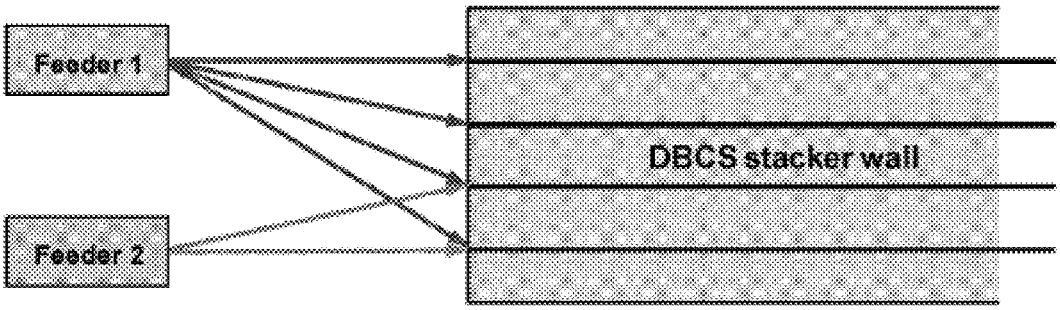
FIG. 3 shows a functional diagram of a further embodiment of the delivery point sorting device.
Figure 4:
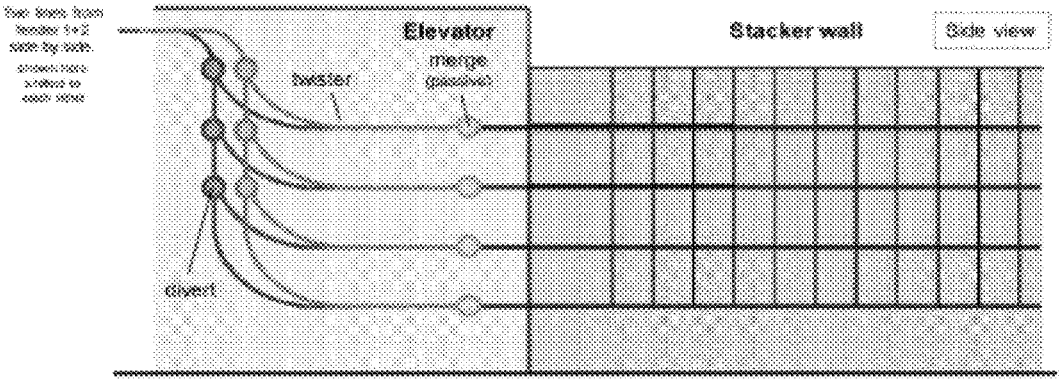
FIG. 4 shows a functional diagram of a further embodiment of the delivery point sorting device.
Figure 5:
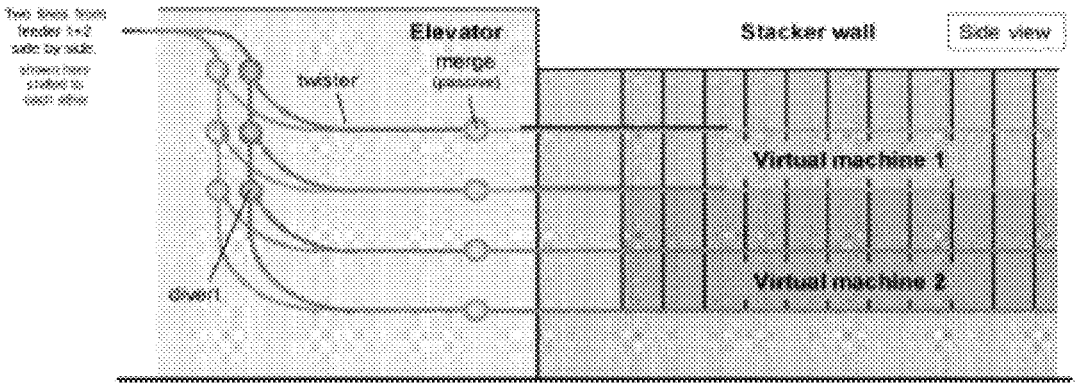
FIG. 5 shows a functional diagram of a further embodiment of the delivery point sorting device.
Figure 6:
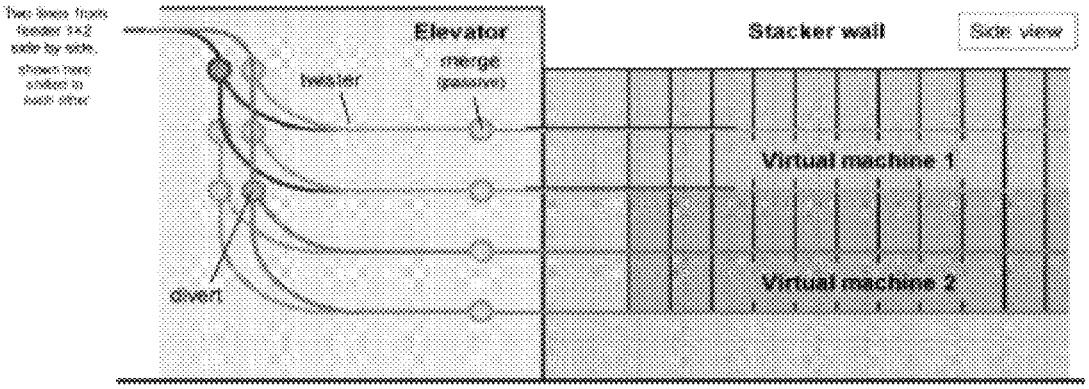
FIG. 6 shows a functional diagram of a further embodiment of the delivery point sorting device.

FIGS. 3-6 show the further exemplary embodiment of a device according to the present invention, where a simultaneous convergence of the two streams of items of mail from the feeders is not necessary. In this embodiment, it is only possible to implement arrangements which use two virtual machines, and in the first sorting process the four levels of the stacker wall are served by just one feeder:

FIG. 3 shows the function of the convergence device without simultaneous convergence in the case of two feeders. FIG. 4 shows the convergence device without simultaneous convergence necessary for the sorting passes 1, 2, 3 in the case of two feeders. The two lines from the feeder flow through the divert module, through the passive merge module, finally into the stacker wall matrix. FIG. 5 shows the convergence device without simultaneous convergence during the sorting pass 1 in the case of two feeders. The two lines from the feeder flow through the divert module, through the passive merge module, finally into the stacker wall with the two virtual machines. FIG. 6 shows the convergence device without simultaneous convergence during the sorting passes 2 and 3 in the case of two feeders.

The invention claimed is:

1. A method for delivery point sorting, the method comprising:

sorting items of mail through a plurality of sorting passes including a first sorting pass, a second sorting pass and a third sorting pass;

in at least two of said sorting passes, processing mail articles through at least two feeders by receiving the mail articles by the at least two feeders and forwarding the mail articles in streams of mail articles;

converging the streams of mail articles from the at least two feeders to at least one conveyor apparatus in each of said sorting passes;

loading the mail articles at sorting endpoints by the at least one conveyor apparatus in each of said sorting passes;

sequentially passing the mail articles through the first sorting pass, subsequently through the second sorting pass, and subsequently through the third sorting pass;

in the first sorting pass:

providing two virtual machines, each with half of the number of sorting endpoints;

preventing simultaneous converging of the stream of mail articles from the at least two feeders; and using only one of said at least two feeders to serve both virtual machines.

2. The method for delivery point sorting according to claim 1, wherein the method further comprises simultaneously converging the stream of mail articles from the at least two feeders.

3. The method for delivery point sorting according to claim 1, wherein the method further comprises converging the stream of mail articles non-simultaneously.

4. The method for delivery point sorting according to claim 1, wherein after the second sorting pass only one of the at least two feeders processes mail articles.

5. The method for delivery point sorting according to claim 1, which further comprises, storing or delaying the mail articles in a storage module for a specific time in a stationary state between said sorting passes, where said storage module is arranged upstream of a merge module in a flow direction of said streams of mail articles.

6. The method for delivery point sorting according to claim 1, which comprises, after the first sorting pass, dividing a volume of the mail articles from the first sorting pass into respectively equal parts between the two feeders at each sorting end point.

* * * * *